US011837139B2

(12) United States Patent
Zheng et al.

(10) Patent No.: US 11,837,139 B2
(45) Date of Patent: Dec. 5, 2023

(54) METHOD FOR COLLECTION AND CORRECTION OF DISPLAY UNIT

(71) Applicant: Changchun Cedar Electronics Technology Co., Ltd, Changchun (CN)

(72) Inventors: Xifeng Zheng, Changchun (CN); Xinyue Mao, Changchun (CN); Tiefu Ding, Changchun (CN); Guixin Guo, Changchun (CN); Yang Wang, Changchun (CN)

(73) Assignee: CHANGCHUN CEDAR ELECTRONICS TECHNOLOGY CO., LTD, Changchun (CN)

( * ) Notice: Subject to any disclaimer, the term of this patent is extended or adjusted under 35 U.S.C. 154(b) by 0 days.

(21) Appl. No.: 17/895,271

(22) Filed: Aug. 25, 2022

(65) Prior Publication Data

US 2022/0415238 A1 Dec. 29, 2022

Related U.S. Application Data

(63) Continuation of application No. PCT/CN2020/086311, filed on Apr. 23, 2020.

(51) Int. Cl.
*G09G 3/20* (2006.01)

(52) U.S. Cl.
CPC ... *G09G 3/2003* (2013.01); *G09G 2320/0233* (2013.01); *G09G 2320/0242* (2013.01);
(Continued)

(58) Field of Classification Search
CPC ... G09G 2320/0233; G09G 2320/0242; G09G 2320/0693; G09G 2360/145; G09G 3/2003; G09G 3/32; G09G 5/10
See application file for complete search history.

(56) References Cited

U.S. PATENT DOCUMENTS 11,176,859 B2 * 11/2021 Orio ..... G09G 3/3208
11,200,828 B2 * 12/2021 Shih ..... G06F 3/1423
(Continued)

FOREIGN PATENT DOCUMENTS

CN 1308465 A 8/2001
CN 102723054 A 10/2012
(Continued)

*Primary Examiner* — Kenneth Bukowski
(74) *Attorney, Agent, or Firm* — IPRO, PLLC; Na Xu

(57) ABSTRACT

Disclosed is a method for collection and correction of a display unit. The method includes: placing a camera in front of a display unit to be corrected; collecting RGB brightness data of the display unit to be corrected to obtain an original brightness matrix; placing a standard brightness plane in front of a lens of the camera; obtaining a final brightness correction matrix of the camera according to the collected RGB brightness data of the standard brightness plane; multiplying the original brightness matrix by the final brightness correction matrix to obtain a restored real brightness matrix; and performing brightness correction on the real brightness matrix to obtain a corrected brightness matrix. A plurality of the display units corrected by the present disclosure are completely the same in terms of absolute brightness value, and positions of the display units can be arbitrarily changed with each other on the screen.

8 Claims, 3 Drawing Sheets

(52) U.S. Cl.
CPC ..... *G09G 2320/0693* (2013.01); *G09G 2360/145* (2013.01)

(56) References Cited

U.S. PATENT DOCUMENTS

| | | | | |
|---|---|---|---|---|
| 11,317,067 | B2 * | 4/2022 | Fan | H04N 17/004 |
| 2014/0152706 | A1 * | 6/2014 | Park | G09G 3/2003 345/690 |
| 2019/0191153 | A1 * | 6/2019 | Speigle | G09G 5/10 |
| 2021/0029332 | A1 * | 1/2021 | Hsiao | H04N 9/3182 |

FOREIGN PATENT DOCUMENTS

| | | | | |
|---|---|---|---|---|
| CN | 103327259 | A | | 9/2013 |
| CN | 103426403 | A | | 12/2013 |
| CN | 104599632 | A | * | 5/2015 |
| CN | 105096815 | A | | 11/2015 |
| CN | 108320696 | A | | 7/2018 |
| JP | 5468914 | B2 | | 4/2014 |

* cited by examiner

METHOD FOR COLLECTION AND CORRECTION OF DISPLAY UNIT

TECHNICAL FIELD

The present disclosure belongs to the technical field of collection and correction of display screens.

BACKGROUND

Curved surface distortion in camera collection is inevitable. Taking red collection of a certain camera as an example, a horizontal profile of the brightness curved surface is shown in FIG. 1. As can be seen from the figure, the flatness error of the curved surface exceeds 20%, which indicates a large distortion. Therefore, the collection and correction results of all the display units of the complete screen must be curved surfaces containing such distortion. Such brightness curved surfaces cannot be spliced into a plane. As a result, such distortion must be corrected during flatness correction. The method for correcting the curved surface distortion in a camera field of view usually includes using the camera to collect targets with the same brightness, determining the distorted curved surface in the camera field of view and performing correction. This process is called calibration. There are many ways to calibrate a camera, but with only one purpose: to correct the curved surface in the camera field of view into a nearly ideal plane. After the calibration, a correction matrix is obtained. Every time after the collection, the collection result is corrected using the correction matrix to obtain a flat collected plane. Such correction is flat plane correction.

All LED display screens are made up of a plurality of basic display units spliced together. The correction of a display screen usually includes correcting one or more display units at a time and then splicing the corrected display units into a complete screen. If a calibrated camera is used to complete each collection and correction and all the obtained results are nearly ideal planes and have the same brightness, such correction results can be spliced into a complete display screen with no brightness difference. The traditional camera calibration method is realized by using an integrating sphere or a uniform whiteboard. However, since each pixel of an LED display unit has different luminous intensity at each angle, the camera calibrated by the integrating sphere or the uniform whiteboard may be affected by a viewing angle error when used in the collection process of the LED display unit, and it cannot be ensured that the nearly ideal plane may be obtained by collection and correction, which affects the splicing effect.

In the meanwhile, in the actual correction process of the display screen, the lens of the camera must be adjusted according to the brightness and shape of the light spot of the collection target. When the aperture and the focusing ring on the lens of the camera are rotated, the relative position of the combination of lenses inside the camera changes, and the law of the collected curved surface of the camera also changes. Most professional industrial cameras do not have an electronic shutter, an electronic aperture or an electronic focusing mechanism, so their shutter, aperture and focus are manually adjusted. Such adjustments are hard to quantify, track and uniformize. As a result, the industrial cameras without electronic shutter, electronic aperture and electronic focusing mechanism cannot fix the collected curved surfaces of the cameras, and thus the calibration of the cameras cannot be uniformized. This is one of the main reasons why the correction effect is usually not ideal.

SUMMARY

The technical problem to be solved by the present disclosure is to provide a method for collection and correction of a display unit. After the collection and correction of the method, a nearly ideal flat display unit brightness matrix can be obtained.

In order to solve the above technical problem, the method for collection and correction of a display unit of the present disclosure includes:

step I: placing a camera in front of the display unit to be corrected, such that a center normal of the display unit to be corrected coincides with an optical axis of the camera;

step II: collecting RGB brightness data of the display unit to be corrected to obtain an original brightness matrix; placing a standard brightness plane in front of a lens of the camera, and keeping a center normal of the standard brightness plane coincident with the optical axis of the camera; collecting RGB brightness data of the standard brightness plane, and obtaining a final brightness correction matrix of the camera according to the RGB brightness data of the standard brightness plane;

step III: multiplying the original brightness matrix by the final brightness correction matrix of the camera to obtain a restored real brightness matrix without curved surface distortion of the camera; and step IV: performing brightness correction on the real brightness matrix to obtain a corrected brightness matrix, thereby completing on-site collection and correction of the display unit.

In step II, the standard brightness plane has the same size and resolution as the display unit to be corrected; and the standard brightness plane is placed at the position of the display unit to be corrected, the RGB brightness data of the standard brightness plane is collected, and a reciprocal thereof is taken to obtain the final brightness correction matrix of the camera.

In step II, it is assumed that the standard brightness plane is an nxm pixel display unit, the display unit to be corrected is an N×M pixel display unit, $n<N$, $m<M$, and the standard brightness plane has the same size as the display unit to be corrected; the standard brightness plane is placed at the position of the display unit to be corrected, the RGB brightness data of the standard brightness plane is collected, and a reciprocal thereof is taken to obtain an original brightness correction matrix of the camera; an interpolation is performed on the original brightness correction matrix to obtain an L×H intermediate brightness correction matrix; and a decimation is performed on the intermediate brightness correction matrix to obtain an N×M final brightness correction matrix, wherein $L \geq N$ and $H \geq M$.

In step II, it is assumed that the standard brightness plane is an nxm pixel display unit, the display unit to be corrected is an N×M pixel display unit, $n=N$, $m=M$, and the standard brightness plane has a smaller size than the display unit to be corrected; the standard brightness plane is placed at a position between the display unit to be corrected and the camera, such that the standard brightness plane in the camera field of view just completely covers the display unit to be corrected; and the RGB brightness data of the standard brightness plane is collected, and a reciprocal thereof is taken to obtain the final brightness correction matrix of the camera.

In step II, it is assumed that the standard brightness plane is an nxm pixel display unit, the display unit to be corrected is an N×M pixel display unit, n<N, m<M, and the standard brightness plane has a smaller size than the display unit to be corrected; the standard brightness plane is placed at a position between the display unit to be corrected and the camera, such that the standard brightness plane in the camera field of view just completely covers the display unit to be corrected; the RGB brightness data of the standard brightness plane is collected, and a reciprocal thereof is taken to obtain an original brightness correction matrix of the camera; an interpolation is performed on the original brightness correction matrix to obtain an L×H intermediate brightness correction matrix; and a decimation is performed on the intermediate brightness correction matrix to obtain the N×M final brightness correction matrix, wherein L≥N and H≥M.

In step II, it is assumed that the standard brightness plane is an nxm pixel display unit, the display unit to be corrected is an N×M pixel display unit, n=N, m=M, and the standard brightness plane has a larger size than the display unit to be corrected; the standard brightness plane is placed at a position behind the display unit to be corrected, such that the standard brightness plane in the camera field of view just completely covers the display unit to be corrected; and the display unit to be corrected is moved away, the RGB brightness data of the standard brightness plane is collected, and a reciprocal thereof is taken to obtain the final brightness correction matrix of the camera.

In step II, it is assumed that the standard brightness plane is an nxm pixel display unit, the display unit to be corrected is an N×M pixel display unit, n>N, m>M, and the standard brightness plane has a larger size than the display unit to be corrected; the standard brightness plane is placed at a position behind the display unit to be corrected, such that the standard brightness plane in the camera field of view just completely covers the display unit to be corrected; the display unit to be corrected is moved away, the RGB brightness data of the standard brightness plane is collected, and a reciprocal thereof is taken to obtain the original brightness correction matrix of the camera; an interpolation is performed on the original brightness correction matrix to obtain an L×H intermediate brightness correction matrix; and a decimation is performed on the intermediate brightness correction matrix to obtain the N×M final brightness correction matrix, wherein L≥N and H≥M.

In step II, it is assumed that the standard brightness plane is an nxm pixel display unit, the display unit to be corrected is an N×M pixel display unit, n>N, m>M, and the standard brightness plane has a larger size than the display unit to be corrected; after the RGB brightness data of the display unit to be corrected is collected to obtain the original brightness matrix, coordinates of four corners of the display unit to be corrected in the camera field of view are recorded; the standard brightness plane is placed in front of the lens of the camera, the RGB brightness data of the standard brightness plane is collected, and a reciprocal thereof is taken to obtain an original brightness correction matrix of the camera; an interpolation is performed on the original brightness correction matrix to obtain an L'×H' intermediate brightness correction matrix, wherein L' and H' are respectively the numbers of rows and columns of pixels of the camera; and a decimation is performed on the intermediate brightness correction matrix corresponding to an area defined by the coordinates of the four corners to obtain the N×M final brightness correction matrix.

Beneficial effects: First, the position of the camera, and the shutter, aperture and focus of the camera are adjusted on site according to the actual situation of the display unit to be corrected such that the best comprehensive effect can be achieved while considering the shape and brightness of the RGB light spots. After the adjustments of the camera are completed, the camera is no longer adjusted. The RGB brightness data of the standard brightness plane is collected, and the brightness correction matrix is obtained according to the RGB brightness data of the standard brightness plane, thereby completing the camera calibration on site in real time. Then the brightness correction matrix is used to perform flatness correction on the display unit to be corrected, which is equivalent to restoring the real brightness matrix without curved surface distortion of the camera. Conventional brightness correction is performed on the real brightness matrix, and the corrected brightness matrix which is completely flat can be obtained. A plurality of the display units corrected in this way are completely the same in terms of both flatness and absolute brightness value, and thus positions of the display units can be arbitrarily changed with each other on the display screen and the display unit in any position on the display screen can be replaced. The present disclosure can be used for on-site correction and on-site maintenance.

BRIEF DESCRIPTION OF FIGURES

The present disclosure will be further described in detail below in conjunction with the accompanying drawings and specific embodiments.

DETAILED DESCRIPTION

Example 1

A standard brightness plane used in this example has the same size and resolution as a display unit to be corrected.

Figure 1:
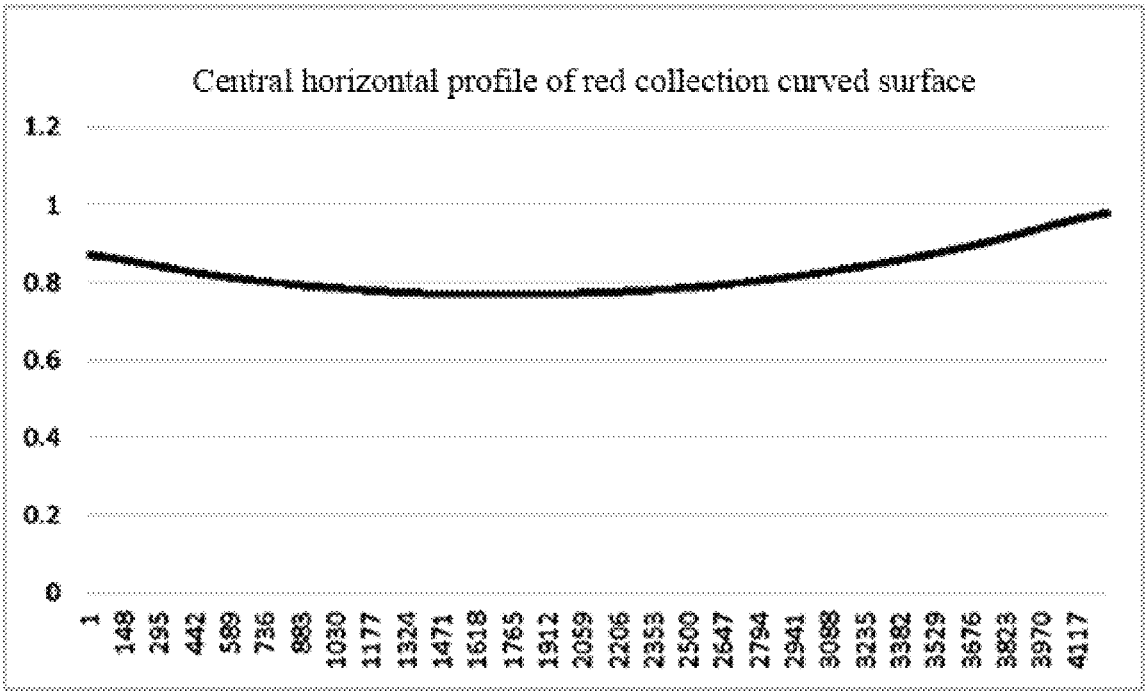
FIG. 1 is a horizontal profile of a red collection brightness curved surface in the prior art.
Figure 2:
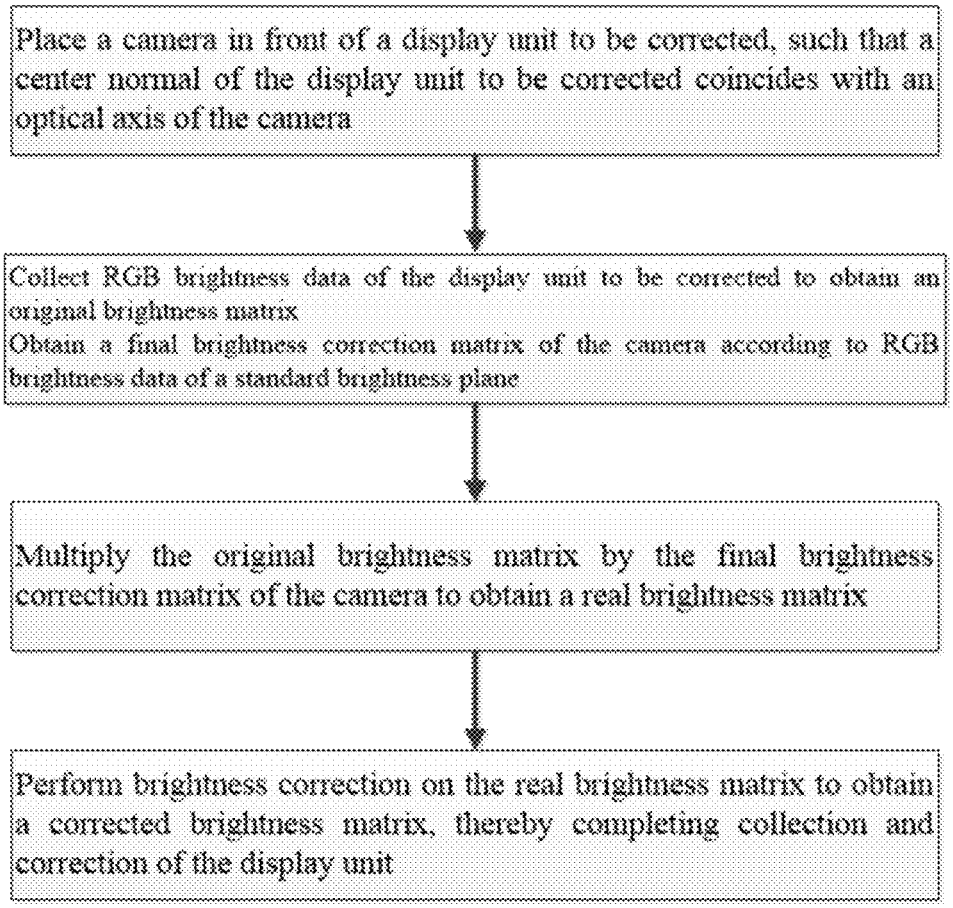
FIG. 2 is a flow diagram of the present disclosure.

As shown in FIG. 2, an on-site collection and correction method of a display unit according to the present disclosure includes the following steps:

Step I: In the preparation stage, a camera is placed in front of the display unit to be corrected such that a center normal of the display unit to be corrected coincides with an optical axis of the camera. The distance between the camera and the display unit to be corrected, and the shutter, aperture and focus of the camera are adjusted while considering the brightness and shape of an RGB light spot, such that RGB data can be collected in an ideal state. After these adjustments, the camera is no longer adjusted.

Step II: The display unit to be corrected is moved away. The standard brightness plane is placed at the position where the display unit to be corrected is originally located. A center normal of the standard brightness plane is also kept coincident with the optical axis of the camera. RGB brightness data of the standard brightness plane is collected point by point, and a reciprocal thereof is taken to obtain a final brightness correction matrix of the camera, thereby completing camera calibration on site.

Step III: The display unit to be corrected is placed back to its original position to replace the standard brightness plane. RGB brightness data of the display unit to be corrected is collected point by point by the camera to form an original brightness matrix. This original brightness matrix is multiplied by the final brightness correction matrix of the camera, which is equivalent to restoring a real brightness matrix without curved surface distortion of the camera.

Step IV: Conventional brightness correction is performed on the real brightness matrix, and a corrected brightness matrix which is completely flat can be obtained, thereby completing the on-site collection and correction of the display unit. A plurality of the display units corrected in this way are completely the same in terms of both flatness and absolute brightness value, and thus positions of the display units can be arbitrarily changed with each other on the display screen and the display unit in any position on the display screen can be replaced.

"Steps III and IV" are repeated, such that a plurality of the display units or all the display units on the display screen can be corrected, thereby completing the correction of the whole display screen.

Example 2

A standard brightness plane used in this example has the same size as a display unit to be corrected and a smaller resolution than the display unit to be corrected.

Taking a standard brightness plane with an 8×8 pixel matrix and a display unit to be corrected with a 16×16 pixel matrix as an example, an on-site collection and correction method of the display unit according to the present disclosure includes the following steps:

Step I: In the preparation stage, a camera is placed in front of the display unit to be corrected such that a center normal of the display unit to be corrected coincides with an optical axis of the camera. The distance between the camera and the display unit to be corrected, and the shutter, aperture and focus of the camera are adjusted while considering the brightness and shape of an RGB light spot, such that RGB data can be collected in an ideal state. After these adjustments, the camera is no longer adjusted.

Step II: The display unit to be corrected is moved away. The standard brightness plane is placed at the position where the display unit to be corrected is originally located. A center normal of the standard brightness plane is also kept coincident with the optical axis of the camera. RGB brightness data of pixels in odd rows and columns of the standard brightness plane is collected first, and then RGB brightness data of pixels in even rows and columns of the standard brightness plane is collected. A reciprocal of the brightness of each pixel is taken to obtain an 8×8 original brightness correction matrix of the camera, thereby completing camera calibration on site.

Step III: An interpolation is performed on the original brightness correction matrix to obtain a 16×16 final brightness correction matrix.

Step IV: The display unit to be corrected is placed back to its original position to replace the standard brightness plane. Using the camera, RGB brightness data of pixels in odd rows and columns of the display unit to be corrected is collected first, and then RGB brightness data of pixels in even rows and columns of the display unit to be corrected is collected, thereby obtaining a 16×16 brightness matrix. This brightness matrix is multiplied by the final brightness correction matrix of the camera, which is equivalent to restoring a real brightness matrix without curved surface distortion of the camera. Conventional brightness correction is performed on the real brightness matrix, and a corrected brightness matrix which is completely flat can be obtained, thereby completing the collection and correction of the display unit.

Example 3

A standard brightness plane used in this example has a smaller size than a display unit to be corrected.

Figure 3:
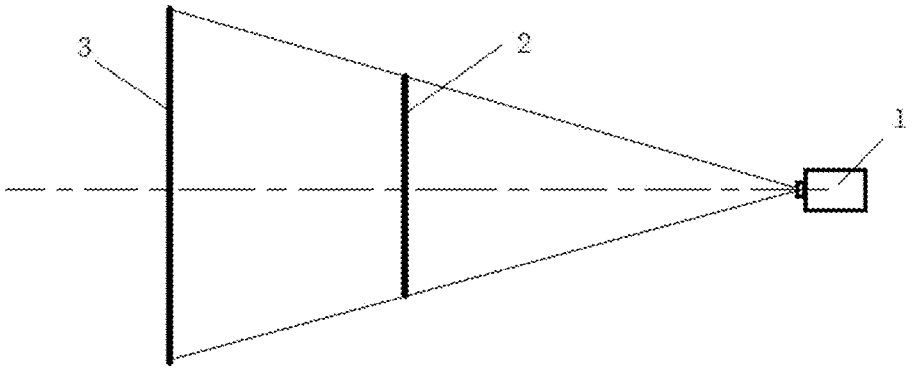
FIG. 3 is a schematic diagram showing a brightness collection pattern of Examples 3 and 4.

As shown in FIG. 3, taking a standard brightness plane with an 8×8 pixel matrix and a display unit to be corrected with an 8×8 pixel matrix as an example, an on-site collection and correction method of a display unit according to the present disclosure includes the following steps:

Step I: In the preparation stage, a camera is placed in front of the display unit to be corrected such that a center normal of the display unit 3 to be corrected coincides with an optical axis of the camera 1. The distance between the camera and the display unit to be corrected, and the shutter, aperture and focus of the camera are adjusted while considering the brightness and shape of an RGB light spot, such that RGB data can be collected in an ideal state. After these adjustments, the camera is no longer adjusted.

Step II: The standard brightness plane 2 is placed at a certain position in front of the display unit 3 to be corrected, such that the standard brightness plane in the camera 1 field of view just completely covers the display unit 3 to be corrected, and a center normal of the standard brightness plane 2 is also kept coincident with the optical axis of the camera 1. RGB brightness data of the standard brightness plane is collected point by point, and a reciprocal thereof is taken to obtain an 8×8 original brightness correction matrix of the camera, thereby completing camera calibration on site.

Step III: The 8×8 original brightness correction matrix obtained in step II is directly used as a final brightness correction matrix.

Step IV: The standard brightness plane is moved away. RGB brightness data of pixels of the display unit to be corrected is collected point by point by the camera to form a brightness matrix. This brightness matrix is multiplied by the final brightness correction matrix of the camera, which is equivalent to restoring a real brightness matrix without curved surface distortion of the camera. Conventional brightness correction is performed on the real brightness matrix, and a corrected brightness matrix which is completely flat can be obtained, thereby completing the on-site collection and correction of the display unit.

Example 4

A standard brightness plane used in this example has a smaller size than a display unit to be corrected.

As shown in FIG. 3, taking a standard brightness plane with a 7×7 pixel matrix and a display unit to be corrected with an 11×11 pixel matrix as an example, an on-site collection and correction method of a display unit according to the present disclosure includes the following steps:

Step I: In the preparation stage, a camera is placed in front of the display unit to be corrected such that a center normal of the display unit 3 to be corrected coincides with an optical axis of the camera 1. The distance between the camera and the display unit to be corrected, and the shutter, aperture and focus of the camera are adjusted while considering the brightness and shape of an RGB light spot, such that RGB data can be collected in an ideal state. After these adjustments, the camera is no longer adjusted.

Step II: The standard brightness plane 2 is placed at a certain position in front of the display unit 3 to be corrected, such that the standard brightness plane in the camera 1 field of view just completely covers the display unit 3 to be corrected, and a center normal of the standard brightness plane 2 is also kept coincident with the optical axis of the camera 1. RGB brightness data of the standard brightness plane is collected point by point, and a reciprocal thereof is taken to obtain a 7×7 original brightness correction matrix of the camera, thereby completing camera calibration on site.

Step III: An interpolation is performed on the original brightness correction matrix to obtain a 22×22 intermediate brightness correction matrix (two brightness values are inserted between two adjacent pixels). Then, a decimation is performed to obtain an 11×11 brightness data matrix, which is used as a final brightness correction matrix.

Step IV: The standard brightness plane is moved away. RGB brightness data of pixels of the display unit to be corrected is collected point by point by the camera to form a brightness matrix. This brightness matrix is multiplied by the final brightness correction matrix of the camera, which is equivalent to restoring a real brightness matrix without curved surface distortion of the camera. Conventional brightness correction is performed on the real brightness matrix, and a corrected brightness matrix which is completely flat can be obtained, thereby completing the on-site collection and correction of the display unit.

Example 5

A standard brightness plane used in this example has a larger size than a display unit to be corrected.

Figure 4:
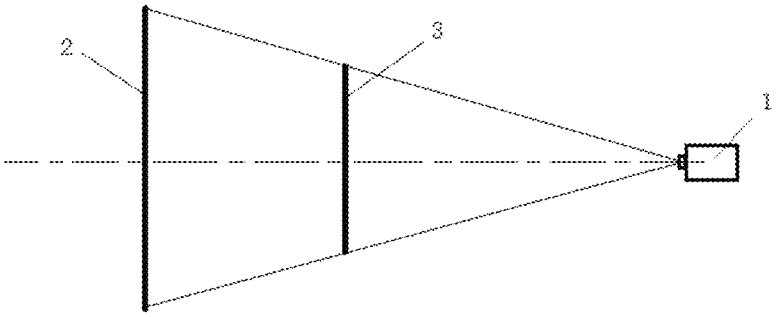
FIG. 4 is a schematic diagram showing a brightness collection pattern of Examples 5 and 6.

As shown in FIG. 4, taking a standard brightness plane with an 8×8 pixel matrix and a display unit to be corrected with an 8×8 pixel matrix as an example, an on-site collection and correction method of a display unit according to the present disclosure includes the following steps:

Step I: In the preparation stage, a camera is placed in front of the display unit to be corrected such that a center normal of the display unit to be corrected coincides with an optical axis of the camera. The distance between the camera and the display unit to be corrected, and the shutter, aperture and focus of the camera are adjusted while considering the brightness and shape of an RGB light spot, such that RGB data can be collected in an ideal state. After these adjustments, the camera is no longer adjusted.

Step II: The standard brightness plane is placed at a certain position behind the display unit to be corrected, such that the standard brightness plane in the camera field of view just completely covers the display unit to be corrected, and a center normal of the standard brightness plane is also kept coincident with the optical axis of the camera. The display unit to be corrected is moved away, RGB brightness data of pixels of the standard brightness plane is collected point by point, a reciprocal thereof is taken to obtain an 8×8 original brightness correction matrix of the camera.

Step III: The 8×8 original brightness correction matrix obtained in step II is directly used as a final brightness correction matrix, thereby completing camera calibration on site.

Step IV: The display unit to be corrected is placed back to its original position, and brightness data of the display unit to be corrected is collected point by point by the camera to form a brightness matrix. This brightness matrix is multiplied by the 8×8 final brightness correction matrix of the camera, which is equivalent to restoring a real brightness matrix without curved surface distortion of the camera. Conventional brightness correction is performed on the real brightness matrix, and a corrected brightness matrix which is completely flat can be obtained, thereby completing the on-site collection and correction of the display unit.

Example 6

A standard brightness plane used in this example has a larger size than a display unit to be corrected.

As shown in FIG. 4, taking a standard brightness plane with a 16×16 pixel matrix and a display unit to be corrected with an 8×8 pixel matrix as an example, an on-site collection and correction method of a display unit according to the present disclosure includes the following steps:

Step I: In the preparation stage, a camera is placed in front of the display unit to be corrected such that a center normal of the display unit to be corrected coincides with an optical axis of the camera. The distance between the camera and the display unit to be corrected, and the shutter, aperture and focus of the camera are adjusted while considering the brightness and shape of an RGB light spot, such that RGB data can be collected in an ideal state. After these adjustments, the camera is no longer adjusted.

Step II: The standard brightness plane is placed at a certain position behind the display unit to be corrected, such that the standard brightness plane in the camera field of view just completely covers the display unit to be corrected, and a center normal of the standard brightness plane is also kept coincident with the optical axis of the camera. The display unit to be corrected is moved away, and RGB brightness data of pixels of the standard brightness plane is collected point by point to obtain a 16×16 original brightness correction matrix.

Step III: A decimation is performed on the 16×16 original brightness correction matrix, and a reciprocal is taken to obtain an 8×8 final brightness correction matrix of the camera, thereby completing camera calibration on site.

Step IV: The display unit to be corrected is placed back to its original position, and brightness data of the display unit to be corrected is collected point by point by the camera to form a brightness matrix. This brightness matrix is multiplied by the 8×8 final brightness correction matrix of the camera, which is equivalent to restoring a real brightness matrix without curved surface distortion of the camera. Conventional brightness correction is performed on the real brightness matrix, and a corrected brightness matrix which is completely flat can be obtained, thereby completing the on-site collection and correction of the display unit.

Example 7

A standard brightness plane used in this example has a larger size than a display unit to be corrected.

Taking a standard brightness plane with an 8×8 pixel matrix and a display unit to be corrected with an 8×8 pixel matrix as an example, an on-site collection and correction method of a display unit according to the present disclosure includes the following steps:

Step I: In the preparation stage, a camera is placed in front of the display unit to be corrected such that a center normal of the display unit to be corrected coincides with an optical axis of the camera. The distance between the camera and the display unit to be corrected, and the shutter, aperture and focus of the camera are adjusted while considering the brightness and shape of an RGB light spot, such that RGB data can be collected in an ideal state. Coordinates of four corners of the display unit to be corrected in the camera field of view are determined, and the camera is no longer adjusted.

Step II: The display unit to be corrected is moved away. The standard brightness plane is placed at the position where the display unit to be corrected is originally located. A center normal of the standard brightness plane is also kept coincident with the optical axis of the camera. RGB brightness data of the standard brightness plane is collected point by point, and a reciprocal of the RGB brightness data of the standard brightness plane is taken to obtain an 8×8 original brightness correction matrix of the camera, thereby completing camera calibration on site.

Step III: An interpolation is performed on the 8×8 original brightness correction matrix to obtain a 28×28 intermediate correction matrix. A decimation is performed on a 14×14 brightness matrix corresponding to an area defined by the coordinates of the four corners in step I taken from the intermediate correction matrix to obtain an 8×8 final brightness correction matrix.

Step IV: The display unit to be corrected is placed back to its original position to replace the standard brightness plane. Brightness data of the display unit to be corrected is collected point by point by the camera to form a brightness matrix. This brightness matrix is multiplied by the final brightness correction matrix of the camera, which is equivalent to restoring a real brightness matrix without curved surface distortion of the camera. Conventional correction is performed on the real brightness matrix, and a corrected brightness matrix which is completely flat can be obtained.

The standard brightness plane is an ideal display unit subjected to brightness flatness correction.

Alternatively, in the examples of the present disclosure, after the relative position between the display unit to be corrected and the camera, and the shutter, aperture and focus of the camera are adjusted in step I, the RGB data of the display unit to be corrected may be directly collected to obtain the brightness matrix. After the camera calibration is completed, this brightness matrix may be directly multiplied by the final brightness correction matrix of the camera to obtain the real brightness matrix.

Figure 5:
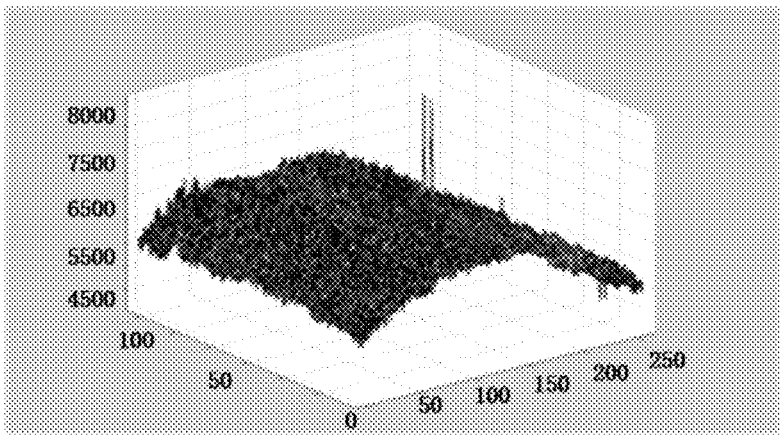
FIG. 5 is a three-dimensional diagram of a brightness matrix collected before correction by the camera according to the present disclosure.
Figure 6:
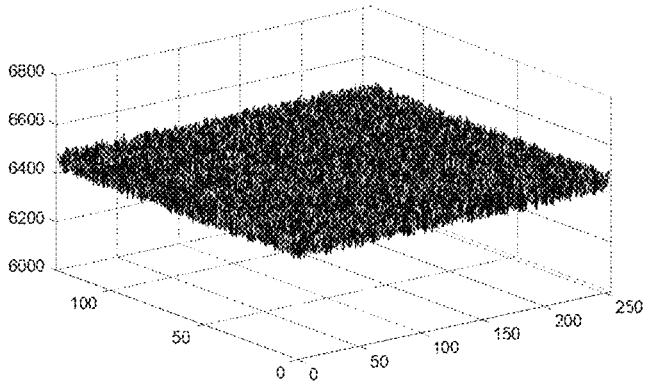
FIG. 6 is a three-dimensional diagram of the brightness matrix collected after correction by the camera according to the present disclosure.

As can be seen from FIGS. 5 and 6, by means of the method of the present disclosure, an ideal corrected brightness matrix which is completely flat can be obtained.

Depending on the resolution, the curved surface to be corrected by the camera may be represented by different matrices. The most delicate way is by camera pixels. The coordinates of the camera field of view are represented by the camera pixels, and points on the curved surface to be corrected by the camera are accurately matched with the camera pixels to obtain an M*N matrix. Then, a decimation is performed on the M*N matrix according to the resolution of the pixels of the display unit to obtain a matrix subset m*n, which is used as a correction matrix for immediate use. As long as the display area to be corrected is within the area calibrated by the camera field of view, ideal flatness correction can be achieved.

If the display area to be corrected is larger than the area calibrated by the camera field of view, then after the adjustments of the camera are completed, instead of placing the standard brightness plane at the position of the display unit to be corrected, the distance is shortened, i.e., the standard brightness plane is placed at a certain position in front of the display unit to be corrected such that the standard brightness plane in the camera field of view completely covers the display unit to be corrected. Then, collection and correction of curved surface distortion of the camera are started.

What is claimed is:

1. A method for collection and correction of a display unit, comprising the following steps:

step I: placing a camera in front of the display unit to be corrected, such that a center normal of the display unit to be corrected coincides with an optical axis of the camera;

step II: collecting RGB brightness data of the display unit to be corrected to obtain an original brightness matrix; placing a standard brightness plane in front of a lens of the camera, and keeping a center normal of the standard brightness plane coincident with the optical axis of the camera; collecting RGB brightness data of the standard brightness plane, and obtaining a final brightness correction matrix of the camera according to the RGB brightness data of the standard brightness plane;

step III: multiplying the original brightness matrix by the final brightness correction matrix of the camera to obtain a restored real brightness matrix without curved surface distortion of the camera; and step IV: performing brightness correction on the real brightness matrix to obtain a corrected brightness matrix, thereby completing on-site collection and correction of the display unit.

2. The method for collection and correction of a display unit according to claim 1, wherein in step II, the standard brightness plane has the same size and resolution as the display unit to be corrected; and the standard brightness plane is placed at the position of the display unit to be corrected, the RGB brightness data of the standard brightness plane is collected, and a reciprocal thereof is taken to obtain the final brightness correction matrix of the camera.

3. The method for collection and correction of a display unit according to claim 1, wherein in step II, it is assumed that the standard brightness plane is a nxm pixel display unit, the display unit to be corrected is a N×M pixel display unit, $n<N$, $m<M$, and the standard brightness plane has the same size as the display unit to be corrected; the standard brightness plane is placed at the position of the display unit to be corrected, the RGB brightness data of the standard brightness plane is collected, and a reciprocal thereof is taken to obtain an original brightness correction matrix of the camera; an interpolation is performed on the original brightness correction matrix to obtain an L×H intermediate brightness correction matrix; a decimation is performed on the intermediate brightness correction matrix to obtain an N×M final brightness correction matrix, wherein $L \geq N$ and $H \geq M$.

4. The method for collection and correction of a display unit according to claim 1, wherein in step II, it is assumed that the standard brightness plane is a nxm pixel display unit, the display unit to be corrected is a N×M pixel display unit, $n=N$, $m=M$, and the standard brightness plane has a smaller size than the display unit to be corrected; the standard brightness plane is placed at a position between the display unit to be corrected and the camera, such that the standard brightness plane in the camera field of view just completely covers the display unit to be corrected; and the RGB brightness data of the standard brightness plane is collected, and a reciprocal thereof is taken to obtain the final brightness correction matrix of the camera.

5. The method for collection and correction of a display unit according to claim 1, wherein in step II, it is assumed that the standard brightness plane is a nxm pixel display unit, the display unit to be corrected is a N×M pixel display unit, n<N, m<M, and the standard brightness plane has a smaller size than the display unit to be corrected; the standard brightness plane is placed at a position between the display unit to be corrected and the camera, such that the standard brightness plane in the camera field of view just completely covers the display unit to be corrected; the RGB brightness data of the standard brightness plane is collected, and a reciprocal thereof is taken to obtain an original brightness correction matrix of the camera; an interpolation is performed on the original brightness correction matrix to obtain an L×H intermediate brightness correction matrix; and a decimation is performed on the intermediate brightness correction matrix to obtain the N×M final brightness correction matrix, wherein L≥N and H≥M.

6. The method for collection and correction of a display unit according to claim 1, wherein in step II, it is assumed that the standard brightness plane is a nxm pixel display unit, the display unit to be corrected is a N×M pixel display unit, n=N, m=M, and the standard brightness plane has a larger size than the display unit to be corrected; the standard brightness plane is placed at a position behind the display unit to be corrected, such that the standard brightness plane in the camera field of view just completely covers the display unit to be corrected; and the display unit to be corrected is moved away, the RGB brightness data of the standard brightness plane is collected, and a reciprocal thereof is taken to obtain the final brightness correction matrix of the camera.

7. The method for collection and correction of a display unit according to claim 1, wherein in step II, it is assumed that the standard brightness plane is a nxm pixel display unit, the display unit to be corrected is a N×M pixel display unit, n>N, m>M, and the standard brightness plane has a larger size than the display unit to be corrected; the standard brightness plane is placed at a position behind the display unit to be corrected, such that the standard brightness plane in the camera field of view just completely covers the display unit to be corrected; the display unit to be corrected is moved away, the RGB brightness data of the standard brightness plane is collected, and a reciprocal thereof is taken to obtain the original brightness correction matrix of the camera; an interpolation is performed on the original brightness correction matrix to obtain an L×H intermediate brightness correction matrix; and a decimation is performed on the intermediate brightness correction matrix to obtain the N×M final brightness correction matrix, wherein L≥N and H≥.

8. The method for collection and correction of a display unit according to claim 1, wherein in step II, it is assumed that the standard brightness plane is a nxm pixel display unit, the display unit to be corrected is a N×M pixel display unit, n>N, m>M, and the standard brightness plane has a larger size than the display unit to be corrected; after the RGB brightness data of the display unit to be corrected is collected to obtain the original brightness matrix, coordinates of four corners of the display unit to be corrected in the camera field of view are recorded; the standard brightness plane is placed in front of the lens of the camera, the RGB brightness data of the standard brightness plane is collected, and a reciprocal thereof is taken to obtain an original brightness correction matrix of the camera; an interpolation is performed on the original brightness correction matrix to obtain an L'×H' intermediate brightness correction matrix, wherein L' and H' are respectively the numbers of rows and columns of pixels of the camera; and a decimation is performed on the intermediate brightness correction matrix corresponding to an area defined by the coordinates of the four corners to obtain the N×M final brightness correction matrix.

* * * * *